US005768724A

United States Patent [19]

Buell

[11] Patent Number: 5,768,724

[45] Date of Patent: Jun. 23, 1998

[54] MODULAR RV FURNITURE AND METHOD

[76] Inventor: V. Donald Buell, 12427 Squaw Valley La., Victorville, Calif. 92392-8843

[21] Appl. No.: 857,369

[22] Filed: May 15, 1997

[51] Int. Cl.[6] ..... A41C 17/34; B60R 1/10

[52] U.S. Cl. ..... 5/118; 5/12.1; 5/59.1; 297/67; 297/440.16; 296/69

[58] Field of Search ..... 297/67, 257, 440.16; 5/8, 12.1, 53.1, 59.1, 118; 296/156, 64, 65.1, 69

[56] References Cited

U.S. PATENT DOCUMENTS

| | | | |
|---|---|---|---|
| 570,207 | 10/1896 | Harry . | |
| 570,208 | 10/1896 | Harry . | |
| 2,432,366 | 12/1947 | Anderson . | |
| 2,645,788 | 7/1953 | Knoll et al. | 5/59.1 |
| 2,656,548 | 10/1953 | Blanke et al. | 5/59.1 |
| 2,710,412 | 6/1955 | Bayer | 5/59.1 |
| 2,774,977 | 12/1956 | Mintz | 5/59.1 X |
| 2,980,923 | 4/1961 | Roche et al. | 5/59.1 |
| 3,036,864 | 5/1962 | Fentaro | 297/440.16 X |
| 3,720,965 | 3/1973 | Wright . | |
| 3,895,840 | 7/1975 | Szurszewski . | |
| 4,066,295 | 1/1978 | Severson | 297/440.16 X |
| 4,940,277 | 7/1990 | Buell | 296/69 X |
| 5,088,135 | 2/1992 | Violette | 297/257 X |
| 5,137,332 | 8/1992 | Gualtierotti et al. . | |
| 5,432,597 | 7/1995 | Rogers . | |

*Primary Examiner*—Michael F. Trettel
*Attorney, Agent, or Firm*—Sheldon & Mak

[57] ABSTRACT

A modular RV furniture apparatus includes a platform, a U-shaped frame having enlargements formed at its leg extremities for insertion through selected socket openings of the platform. A key panel movable under the platform has key openings formed therein for locking the frame in place with the enlargements blocked by the key openings. The leg extremities of the frame are spaced at a distance D, pairs of the socket openings also being spaced at the distance D for permitting the frame to be selectively engaged with the platform and locked in place in a plurality of fixed positions. At least some socket openings are spaced at a center spacing S that is a submultiple of the distance D, a back-support on the frame having a width W being the distance D plus a multiple of the spacing S. A manual or powered locking device holds the key panel in the locked position, an electrical interlock deactivating a vehicle ignition circuit when the key panel is not in the locked position. Also disclosed is a method for converting a recreational vehicle bed to a couch having the back-support in which a pair of platform assemblies are anchored in edge-abutting relation for forming the bed, translation mechanisms moving the platform assemblies laterally for forming an aisle therebetween and longitudinally for selectively providing driver's and passenger's seating.

19 Claims, 4 Drawing Sheets

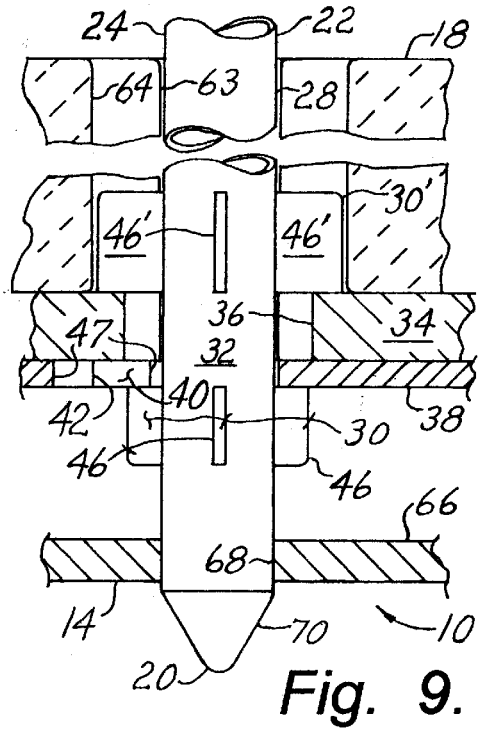
Fig. 9.
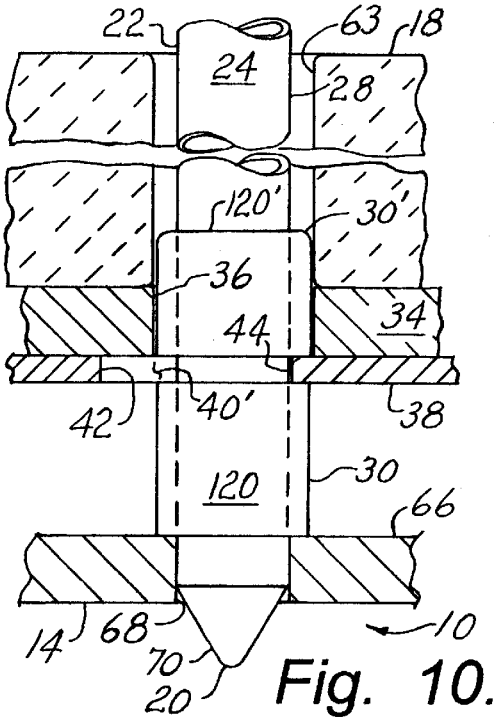
Fig. 10.
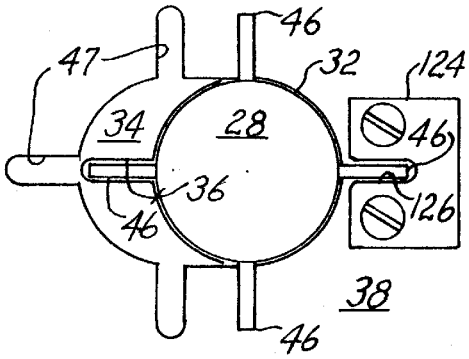
Fig. 13.
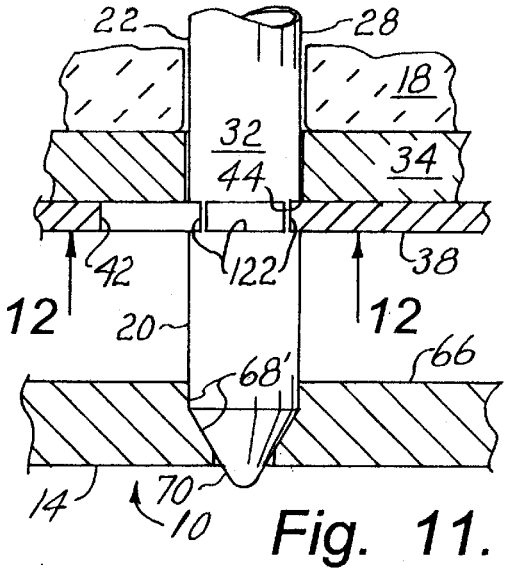
Fig. 11.
Fig. 12.
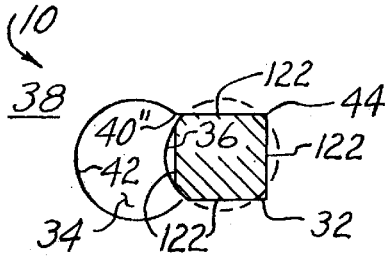

MODULAR RV FURNITURE AND METHOD

BACKGROUND

The present invention relates to recreational vehicle furniture, and more particularly to seating and bedding fixtures for motor homes and the like.

The design of motor homes invites serious compromises between utility, comfort, space or volume, and weight. Motor homes are utilized for traveling, eating, socializing, and sleeping. Conventional fixtures facilitating these uses, such as the front seats of vehicles and seating and sleeping furniture of houses are quite bulky. Typical motor homes of the prior art have smaller and fewer counterparts of these fixtures (other than the front seats) thereby compromising comfort, yet these motor homes are undesirably bulky and heavy, having serious limitations in economy and drivability.

These issues have been addressed in U.S. Pat. No. 4,940,277 to this inventor, which discloses a motorhome having transversely positionable trundles on which are inclinable and translatable cushion portions in addition to a fixed cushion portion. The motorhome of the 277 patent has not proven entirely satisfactory, however, in that the lounge configuration is undesirably limited in length relative to an overall length of the trundle, and faces in only one direction, and there is no provision for longitudinally oriented backrests.

Thus there is a need for recreational vehicle furniture that further improves over the prior art.

SUMMARY

The present invention meets this need by providing a modular furniture apparatus for supporting occupants of a recreational vehicle. In one aspect of the invention, the apparatus includes a platform member having a horizontally disposed supporting surface, a plurality of socket openings being formed in the supporting surface; a frame member having shank portion and a free end, an enlargement being formed on the frame member between at least a portion of the shank portion and the free end; a key member movably supported relative to the platform member opposite the socket openings from supporting surface and having a plurality of key openings formed therein, the enlargement being insertable through a selected socket opening and an entry portion of a key opening in an open position of the key member; the apparatus also having means for holding the key member in a locked position wherein the frame member is rigidly supported and retained in upstanding relation to the platform member.

The frame member can be locked from rotating relative to the platform member when the enlargement is locked by the key member. The frame member can be generally U-shaped, having a parallel-spaced pair of shank portions, each of the shank portions being engageable through corresponding socket openings of the platform member. Preferably the shank portions are spaced at a distance D, a plurality of pairs of the socket openings being correspondingly spaced at the distance D for permitting the frame member to be selectively engaged with the platform member and locked in place in a plurality of fixed positions relative thereto. A combination of the shank portion and the enlargement can be of non-circular cross-section, the platform member in combination with the key member engaging a portion of the frame member having the non-circular cross-section when the enlargement is locked by the key member, thereby preventing rotation of the frame member.

The apparatus can further include a back-support element connected to the frame member. At least some of the socket openings can be spaced at a center spacing S being a submultiple of the distance D, the back-support element having a width W being the distance D plus an approximate multiple of the spacing S for permitting the fixtures to be located with the back-support elements to be in side-abutting relationship.

Preferably the apparatus further includes a locking device for holding the key member in the locked position. The apparatus can be in combination with a vehicle having an engine ignition circuit, the combination further including an electrical interlock for preventing activation of the ignition circuit when the key member is not in the locked position. A hanger can be included for supporting an unused fixture. The platform member can be one of a pair of platform members, each of the platform members being supported on a respective base of a spaced pair of bases, the combination further comprising a translation mechanism for each of the platform members, the translation mechanisms being operative for locating the platform members in proximate edge abutment for forming a bed, and for moving the platform members in a horizontal first direction into horizontally spaced relation for forming an aisle therebetween. At least one of the translation mechanisms can be further operative for moving the corresponding platform member in a horizontal second direction being inclined relative to the first direction.

In another aspect of the invention, a method for converting a recreational vehicle bed to a couch having a back-support element, includes the steps of:

(a) providing a platform assembly having a plurality of socket openings in a horizontally disposed supporting surface, a key member movable under the socket openings and having respective key openings in association with the socket openings, and a mattress pad on the supporting surface for forming a bed, the mattress having passages therethrough for alignment with the socket openings, each key opening having an open portion and a lock portion;

(b) providing a fixture having a back-support element and a frame leg extremity, an enlargement being formed on the leg extremity;

(c) inserting the leg extremity into a selected one of the socket openings with the enlargement having passed through the open portion of the corresponding one of the key openings; and (d) moving the key member for locating the lock portion of the key member over the enlargement for locking the fixture to the platform assembly with the back-support element extending above the mattress pad, thereby to provide a couch.

The step of providing the platform assembly can include providing a pair of platform assemblies, the method including the further steps of anchoring the platform assemblies in edge-abutting relation for forming the bed as a combination of the platform assemblies; and moving at least one of the platform assemblies into horizontally spaced relation with the other of the platform assembly thereby to form an aisle between the platform assemblies. The step of providing the fixture can include providing an interchangeable plurality of fixtures, each fixture having a horizontal facing direction; the step of inserting the leg extremity further includes selectively locating the fixtures in a plurality of orientations of the respective facing directions, the fixtures being locked in the respective orientations. The method can include the further step of locking the key member in the locked position. The method can include the further steps of providing a switched source of vehicle engine ignition power, and activating the engine ignition power only when the lock member is the locked position.

DRAWINGS

These and other features, aspects, and advantages of the present invention will become better understood with reference to the following description, appended claims, and accompanying drawings, where:

FIG. 9 is a fragmentary sectional view as in FIG. 4, showing another alternative configuration of the system of FIG. 1;

FIG. 10 is a fragmentary sectional view, also as in FIG. 4, showing a further alternative configuration of the system of FIG. 1;

FIG. 11 is a fragmentary sectional view, again as in FIG. 1, showing yet another alternative configuration of the system of FIG. 1;

FIG. 12 is a bottom plan sectional view on line 12—12 in FIG. 5; and FIG. 13 is a bottom plan view showing a yet further alternative configuration of a portion of the system of FIG. 1.

DESCRIPTION

Figure 1:
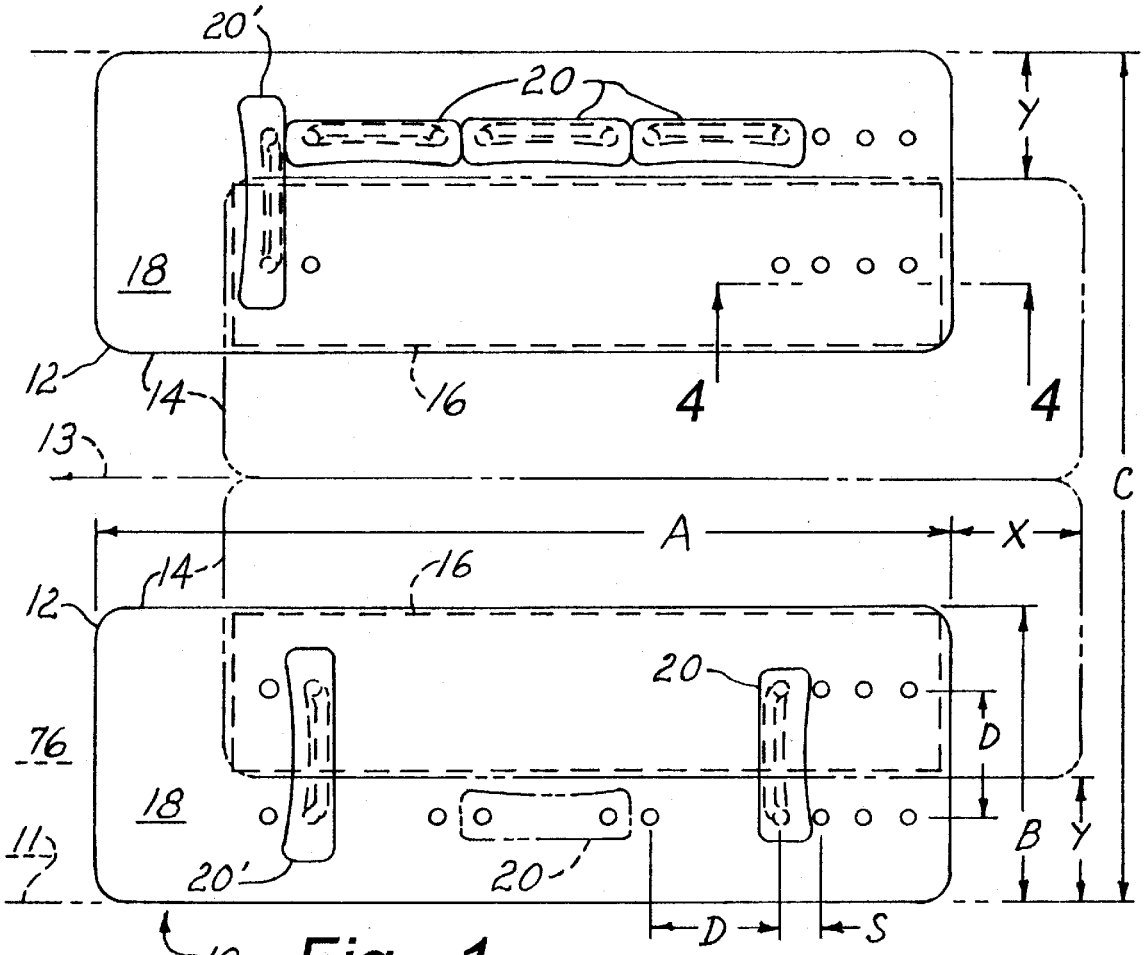
FIG. 1 is a plan view of an installed modular RV furniture system according to the present invention.
Figure 2:
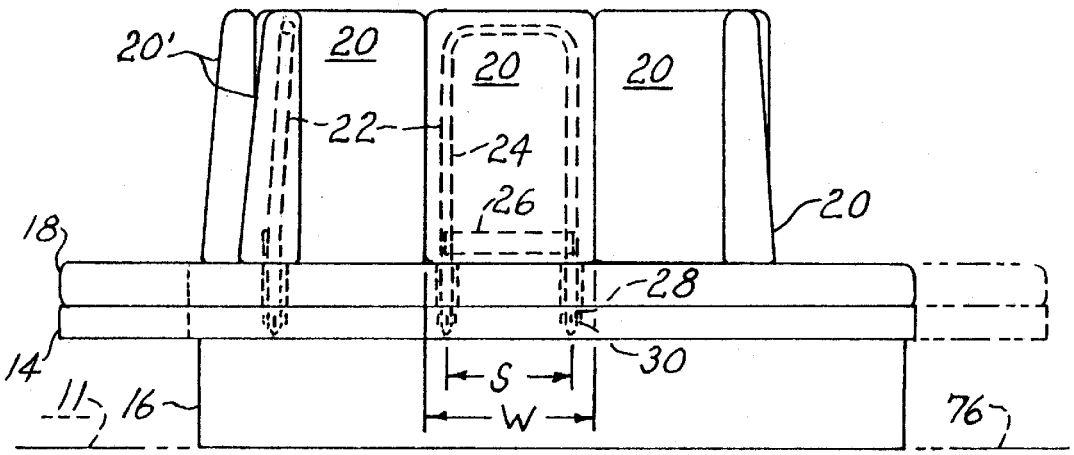
FIG. 2 is a side elevational view of the system of FIG. 1.

The present invention is directed to an RV furniture system that is particularly effective in combining utility and comfort in limited space. With reference to FIGS. 1–7 of the drawings, a furniture system 10 for a recreational vehicle 11 has a pair of seating units 12 disposed on opposite sides of a longitudinal axis 13 of the vehicle 11, a forward direction thereof being indicated by an arrow in FIG. 1. Each of the couch units 12 includes a platform assembly 14 that is translatably supported on a pedestal base 16, the platform assembly 14 having a mattress pad 18 thereon. According to the present invention, the platform assembly 14 is adapted for lockably receiving a plurality of modular fixtures such as back-support modules 20. In an exemplary configuration of the furniture system 10, the back-support modules 20 each include a generally arch-shaped frame 22 that engages the platform assembly 14 as described herein. As shown in FIG. 2, the frame has a U-shaped frame member 24 that is reinforced by a cross-member 26, respective leg extremities 28 of the frame member 24 being parallel-spaced at a center distance D and having enlargements 30 formed thereon, each leg extremity 28 having a cylindrical shank portion 32 that extends above the corresponding enlargement 30. As used herein, the term "enlargement" means a body portion having an upwardly facing surface element that is engageable for preventing upward movement of the body when the body is confined to vertical movement.

Figure 4:
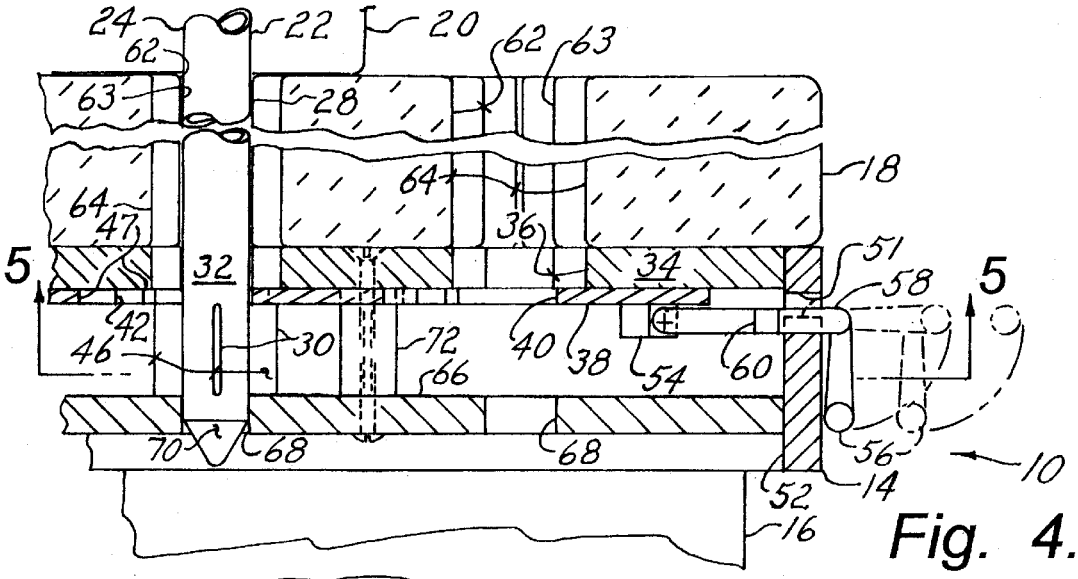
FIG. 4 is a fragmentary sectional elevational detail view on line 4—4 of FIG. 2.
Figure 5:
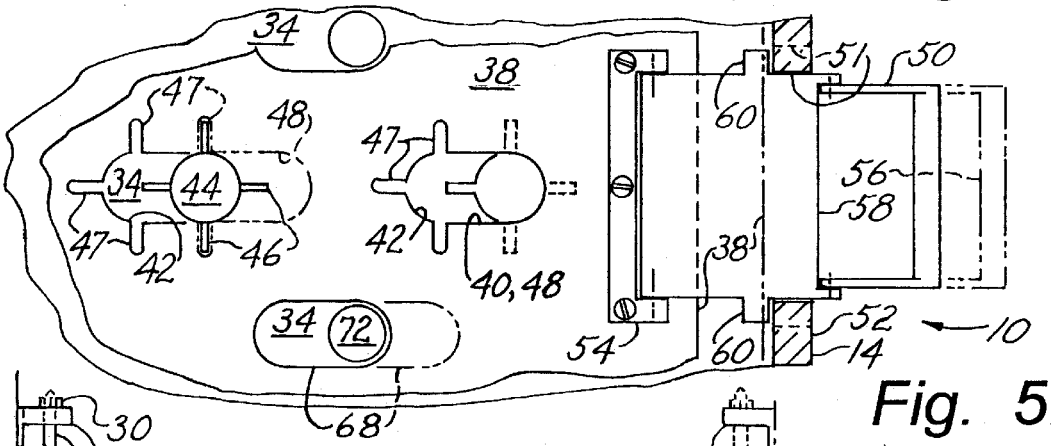
FIG. 5 is a bottom plan sectional view on line 5—5 of FIG. 4.

As shown in FIGS. 4 and 5, the platform assemblies 14 each include a platform panel 34 for supporting the mattress pad 18, the panel 34 having a plurality of socket openings 36 formed therein for receiving the leg extremities 28 of the back-support modules, a key member 38 being translatably supported under the platform panel 34 and having respective key openings 40 formed therein in association with corresponding ones of the socket openings 36. The key member 38 has an open position as indicated by dashed lines in FIG. 5 wherein the leg extremities 28 are insertable into the socket openings 36 with the enlargements 30 passing through respective entry portions 42 of corresponding key openings 40, and a locked position as indicated by solid lines in FIG. 5 wherein the enlargements 30 are blocked from being withdrawn through respective lock portions 44 of the key openings 40. As further shown in FIGS. 4 and 5, an exemplary configuration of the enlargements is provided by a quartet of blade members 46 that project orthogonally outwardly from the leg extremities 28, the leg extremities 28 being circularly cylindrical. Correspondingly, the entry portion 42 of each key opening 40 includes three orthogonally oriented blade slots 47 that extend radially outwardly from a semi-circular end portion of a shank slot 48. The lock portion 44 is formed by an oppositely facing semi-circular end portion of the shank slot 48 that does not have counterparts of the blade slots 47.

In the configuration of FIGS. 4 and 5, a manual lock actuator is provided by a handle assembly 50 for positioning the key member 38, the handle assembly 50 projecting through a handle opening 51 of a rear end bezel member 52 of the platform assembly 14. The handle assembly 50 includes a pivot mount 54 that is rigidly fastened to the key member 38, a handle member 56, and a link member 58 that is pivotally connected between the mount 54 and the handle member 56. The link member 58 has a pair of lock projections 60 formed thereon for preventing movement of the key member 38 to the open position unless the link member 58 is pivoted slightly upwardly from a rest position thereof, an upper portion of the handle opening 51 being enlarged for clearing the lock projections 60. Thus the key member 38 is secured in the locked position against inadvertent unlocking of the back-support modules 20, the unlocking requiring a combination of lifting and pulling of the handle member 56 upwardly and outwardly from the bezel member 52.

The mattress pad 18 also has a plurality of cylindrical passages 62 extending therethrough for receiving the leg extremities 28 of the back-supporting modules 20, the passages 62 being located for alignment with the socket openings of the platform panel 34. In the exemplary configuration shown in FIGS. 1–7, the passages 62 are preferably formed with a circularly cylindrical central portion 63 for receiving the shank portions 32, and counterparts of the blade slots, designated 64, radially extending from the central portion 63 for receiving the blade members 46 while retaining significant of load-carrying capacity and continuity of the pad 18 in the vicinity of the passages 62.

Figure 3:
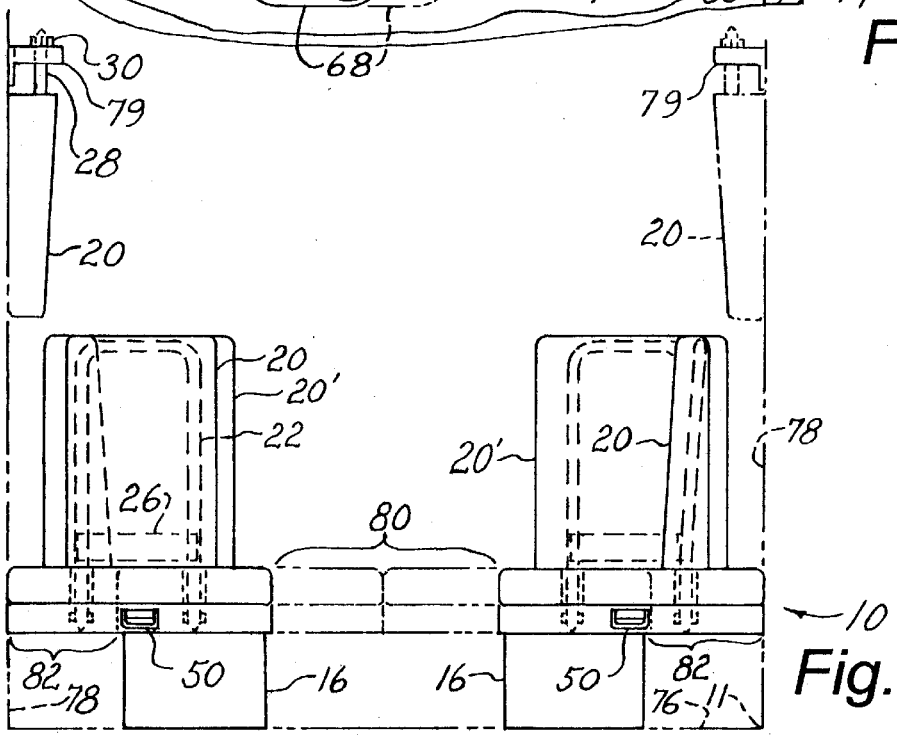
FIG. 3 is a rear elevational view of the system of FIG. 1.

The socket openings 36 are preferably located with pairs thereof having a center spacing corresponding to the center distance D of the leg extremities 28 of the back-support modules 20 for permitting selective mounting of the back-support module or modules 20 in a plurality of locations on each of the platform assemblies. More preferably, the openings 36 are located at intersections of a uniformly spaced square grid of spacing S, the spacing S being a submultiple of the distance D for permitting greater freedom of choice in positioning the modules 20. In the drawings, the spacing S is ⅓ of the distance D, a suitable size of the spacing S being approximately 4 inches. Importantly, the modules 20 are locatable with both lateral and longitudinal orientations as best shown in FIG. 1. Further, FIGS. 1–3 show the system 10 having the back-support modules in a first configuration having a width W being approximately four times the spacing S for permitting the modules 20 to be located in side-abutting relation as shown in the top portion of FIG. 1. Optionally, one or more of the back-supporting modules, designated 20', can have a different width W, such as 5 times the spacing S. The modules 20' are especially suitable for providing enhanced comfort and stability in use at forward-facing seating locations by a driver and passenger when the vehicle 10 is being moved.

In the exemplary configuration of FIGS. 1–7, the back-support modules 20 are rigidly supported against overturning loads by a register panel 66 that is fixedly spaced below the key member 38 in parallel relation to the platform panel 34, and having a plurality of register openings 68 therein for locating end extremities 70 of the leg extremities 28. The register panel 66 is supported by a plurality of spacer posts 72 that extend through corresponding clearance openings 74 of the key member 38, the posts 72 also providing sliding support for the key member 38, the clearance openings 74 being elongated for permitting movement of the key member 38 between the open and locked positions thereof. It will be understood that further sliding support for the key member 38 can be provided along opposite side edges thereof. Also, the frames 22 are vertically supported by the enlargements 30 resting on the register panel 66, the combination of the platform panel 34, the register panel 66, and the rigidly interconnecting spacer posts 72 providing enhanced structural integrity of the platform assembly 14.

In an optional yet important aspect of the present invention, the platform assemblies 14 are translatable as introduced above. More particularly, each platform assembly 14 is horizontally translatable over a distance X in a direction parallel to the vehicle axis 13 and a distance Y in a direction perpendicular to the axis 13 as shown in FIG. 1. In the exemplary configuration of FIGS. 1–7, each platform assembly 14 has a length A and a width B, the vehicle 11 having a floor surface 76 for supporting the bases 16, and opposite upstanding side wall surfaces 78 that are spaced apart by a distance C. The pedestal bases 16 are located such that the platform assemblies are movable from proximate abutment with the wall surfaces 78 at one lateral extremity of the translation distance Y as shown by solid lines in FIGS. 1, 3, and 7, to proximate abutment with each other at an opposite extremity of the translation distance Y as shown by dashed lines in the same figures. FIGS. 1 and 2 also show the platform assemblies 14 being movable from a forward position (solid lines) to a rear position (dashed lines. In positions wherein the platform assemblies are spaced apart, a center aisle 80 is provided between the platform assemblies 14, the aisle 80 having a width of up to 2Y and facilitating side-facing seating on the mattress pads 18. When the platform assemblies 14 are moved together, a bed is centered between the wall surfaces 78, opposite side aisles 82 being created as shown in FIG. 3, each having a width of Y. Also shown in FIG. 3 are a plurality of hangers 79 for supporting unused ones of the back-supports 20 in elevated positions against the wall surfaces 78.

Figure 6:
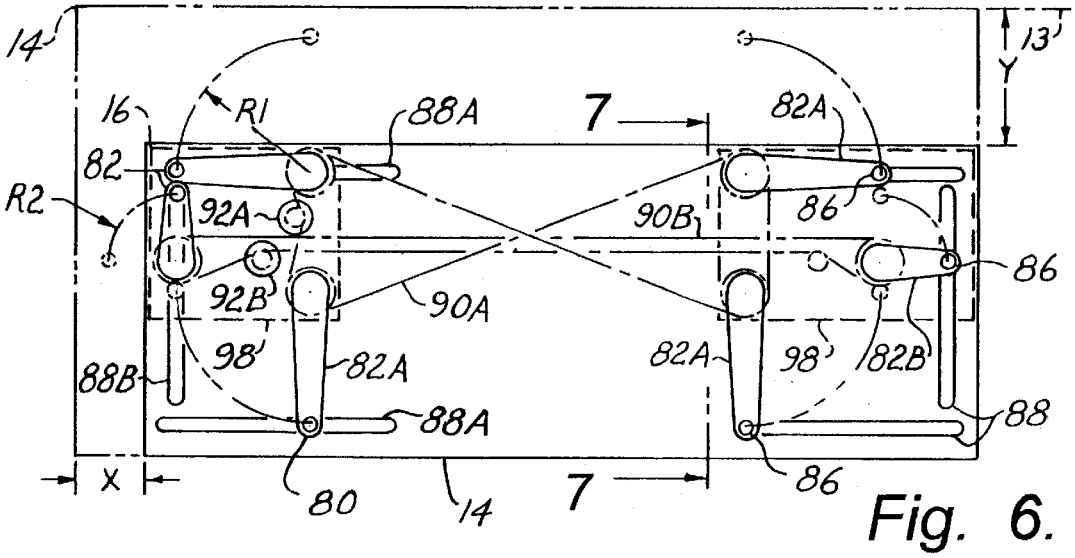
FIG. 6 is a plan diagram view showing a translation mechanism of the system of FIG. 1.
Figure 7:
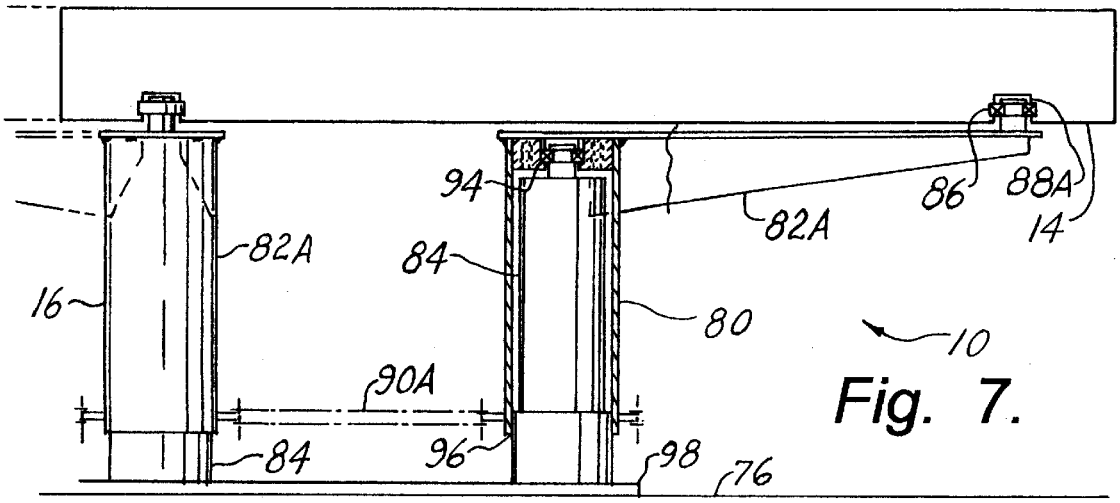
FIG. 7 is a transverse fragmentary sectional elevational view of a portion of the mechanism of FIG. 6 on line 7—7 thereof.

FIGS. 6 and 7 show details of an exemplary translation mechanism 80 that is coupled between the pedestal base 16 and the platform assembly 14. The mechanism 80 includes a plurality of cantilevered arms 82 that are pivotally supported by corresponding columns 84, each of the arms 82 having a follower 86 that engages a corresponding slot 88 of the platform assembly 14. More particularly, a quartet of first arms 82A that engage corresponding first slots 88A are operative for locating the platform assembly 14 in the direction of the distance Y, a pair of second arms 82B and corresponding second slots 88B locating the platform assembly 14 in the direction of the distance X, the arms 82A also stabilizing the platform assembly parallel to the longitudinal axis 13. The first arms 82A are coupled by a first chain drive 90A to a reversible first drive motor 92A for rotation thereby to translate the platform assembly 14 toward and away from the longitudinal axis 13. Similarly, the second arms 82B are coupled by a second chain drive 90B to a second drive motor 92B for translation of the platform assembly 14 in a direction parallel to the longitudinal axis 13. The slots 88 are channeled for supportively engaging the respective rollers 86 of the arms 82, the arms 82 each being supported by a thrust bearing 94 and a sleeve bearing 96 for rotation through approximately 90° for translating the platform assembly over the distances X and Y. Further details of the mechanism 80 include one or more plates 98 to which the columns 84 are affixed (as by welding) and to which the drive motors 92A and 92B are mounted. The first chain drive 90A is crossed as shown in FIG. 6, pairs of the first arms 82A being rotated in opposite directions by the first drive motor 92A. It will be understood that the first chain drive 90A can instead be implemented for driving the first arms 82A in the same direction, the respective first slots 88A being appropriately relocated within the platform assembly 14.

In a typical implementation of the furniture system 10, the length A is approximately 80 inches, and the width B is approximately 28 inches. In FIG. 6, the first arms 82A operate with an effective radius R1 being approximately 12 inches, the second arms 82B having a corresponding radius R2 being approximately 6 inches. Thus the corresponding ranges of the distances X and Y are 6 and 12 inches. Accordingly, the platform assemblies 14 are movable from abutment with each other as shown by dashed lines in FIG. 3 to abutment with the wall surfaces 78 when the distance C is approximately 80 inches, the aisle 80 having a width of 2Y being approximately 24 inches. Advantageously, the mechanism 80 is resistant to unintended movement of the platform assembly 14 when driven to either extremity of both the distances X and Y because at least two of the first arms 82A and one of the arms 82B are oriented perpendicular to the corresponding slot 88. It will be understood that the range of the distance X is doubled to 12 inches by relocating the rearmost column 84 in FIG. 6 rearwardly to alignment with the corresponding slot 88B, and implementing the second chain drive 90B for rotation of the second arms 82B through approximately 180° between opposite extremities of the distance X. Other drive arrangements for horizontally translating the platform assemblies are contemplated, including lead-screw drives as disclosed in U.S. Pat. No. 4,940,277 to the present inventor, which is incorporated herein by this reference.

Figure 8:
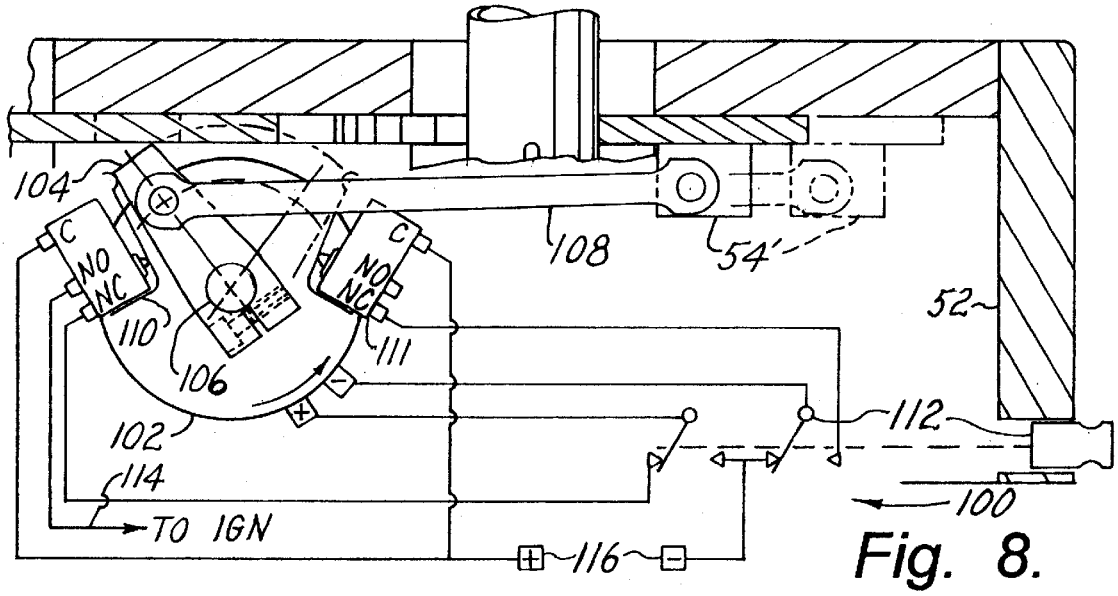
FIG. 8 is a sectional diagrammatic view showing an alternative configuration of the system of FIG. 1.

With further reference to FIG. 8, a powered lock actuator 100 provides an alternative to the handle assembly 50 in the furniture system 50. The actuator 100 includes a reduction gear-motor 102 having a crank 104 rigidly connected to an output shaft 106 thereof. A connecting rod 108 is pivotally connected between the crank 104 and a counterpart of the pivot mount, designated 54', for movement of the key member 38 between the open and locked positions. A pair of limit switches, designated 110 and 111 are operated by the crank for interrupting electrical power to the gear-motor 102 at the respective open and locked positions, and a lock switch 112 that is located for manual access through the rear end bezel member 52. The actuator 100 is wired for powering the gear-motor 102 with positive current (counterclockwise as depicted by the arrow in FIG. 8) when the lock switch 112 is positioned as shown, until the crank 104 reaches the position depicted by solid lines in FIG. 8, whereupon the gear-motor 102 is halted by power being cut off by the limit switch 110. When the switch 112 is moved rearwardly from the position shown in FIG. 8, power is again applied, in reverse polarity, to the gear-motor 102, causing the arm 104 to move toward the position depicted by dashed lines in FIG. 8, corresponding to the open position of the key member 38, whereupon power to the gear-motor 102 is again interrupted, by the limit switch 111. The limit switch 110 also provides an interlocked source of vehicle engine ignition power 114 from a normally open terminal thereof. A common terminal of the limit switch 110 is connected to the positive (+) side of a main source 116 of vehicle power, normally closed terminals of the switches 110 and 111 being connected to opposite sides of respective poles of the lock switch 112. A negative side (–) of the main source 116 is connected to opposite sides of the respective poles of the lock switch 112, common connections thereof being to the gear-motor 102 in the proper polarity for the above-described directions of motor rotation. Thus ignition power to the vehicle 11 is interrupted whenever the key member 38 is moved from the locked position.

With further reference to FIGS. 9–12, the frame members 22 can have alternative configurations of the leg extremities 28, there being in some cases corresponding alternative configurations of the key openings 40. FIG. 9 shows a leg extremity 28 having a secondary enlargement 30' being formed by blade members 46' that are spaced on the shank portion 32 above the blade members 46. The secondary enlargements 30' can extend slightly farther from the shank portion 32 than the blade members 46, for vertically supporting the frame 22 by the secondary blade members 46' resting on the platform panel 34. In this configuration, the spacer posts 72 (FIGS. 4 and 5) are not required to vertically support the enlargements 30.

Another alternative configuration is shown in FIG. 10, wherein the enlargement 30 is formed as a circular member 120, the key member 38 having corresponding key openings 40' wherein the entry portion 42 is circular and slightly larger in diameter than the circular member 120, the socket openings 36 of the platform panel 34 also being circular for clearing the circular member 120. A counterpart of the secondary enlargement 30' in the form of a secondary circular member 120' is affixed on the shank portion 32 in spaced relation above the member 120. The frame 22 is supported by the enlargements 30 resting on the register panel 66 as described above in connection with FIGS. 4 and 5. FIGS. 11 and 12 show a similar alternative wherein the shank portion 32 is formed with a set of orthogonally oriented slots 122 in line with the key member 38, a key opening 40" having the entry portion 42 formed for clearing the shank portion 28 and the lock portion 44 having squared corners for fitting into three of the slots 122. In the configuration of FIGS. 11 and 12 the register panel 66 is formed with counterparts of the register openings, designated 68', being countersunk or otherwise shouldered for vertically supporting the leg extremities 28.

With further reference to FIG. 13, a yet further alternative configuration of the system 10 includes a register block 124 that is rigidly fastened to the underside of the key member 38, the block 124 having a register slot 126 formed therein for preventing rotation of the leg extremity 28 when the key member 38 is in the locked position. Thus counterparts of the back-supports 20 having only one leg extremity 28 are lockable on the platform assembly 14 in a manner that prevents rotation thereof. In the exemplary configuration of the enlargement 30 having the orthogonally projecting blade members 46 as described above, the leg extremity 28 is lockable in any of four orthogonal orientations wherein different ones of the blade members 46 are engaged by the register block 124.

Although the present invention has been described in considerable detail with reference to certain preferred versions thereof, other versions are possible. For example, the back-support modules 20 can be provided in differing configurations wherein the center distance D is any suitable multiple of the spacing S. In the configuration of FIG. 13, a counterpart of the register block 124 can be fixed on the register panel 66 instead of under the key member 38. Also, the system 10 contemplates selective engagement of arm rests and other fixtures in place of the back supports 20. Further, the interlocking of the vehicle engine ignition power by the limit switch 110 can be applied to the manually locked configuration of FIGS. 4 and 5. Therefore, the spirit and scope of the appended claims should not necessarily be limited to the description of the preferred versions contained herein.

What is claimed is:

1. A modular furniture apparatus for supporting occupants of a recreational vehicle, comprising:

(a) a platform member having a horizontally disposed supporting surface, a plurality of socket openings being formed in the supporting surface;

(b) a frame member having shank portion and a free end, an enlargement being formed on the frame member between at least a portion of the shank portion and the free end, the enlargement being insertable through a selected socket opening of the platform member;

(c) a key member movably supported relative to the platform member opposite the socket openings from supporting surface and having a plurality of key openings formed therein, each key opening having an entry portion for passing the enlargement of the frame member and a lock portion for blocking passage of the enlargement while receiving the shank portion, the key member having an open position wherein the entry portion of each key opening is aligned with a corresponding socket opening of the platform member, and a locked position wherein the lock portion of each key opening is aligned with the corresponding socket opening; and means for holding the key member in the locked position, wherein the frame member is rigidly supported in upstanding relation to the platform member when the enlargement is locked by the key member.

2. The furniture apparatus of claim 1, wherein the frame member is locked from rotating relative to the platform member when the enlargement is locked by the key member.

3. The furniture apparatus of claim 2, wherein the frame member is generally U-shaped, having a parallel-spaced pair of shank portions, each of the shank portions being engageable through corresponding socket openings of the platform member.

4. The furniture apparatus of claim 3, wherein the shank portions are spaced at a distance D, a plurality of pairs of the socket openings being correspondingly spaced at the distance D for permitting the frame member to be selectively engaged with the platform member and locked in place in a plurality of fixed positions relative thereto.

5. The furniture apparatus of claim 2, wherein a combination of the shank portion and the enlargement is of non-circular cross-section, the platform member in combination with the key member engaging a portion of the frame member having the non-circular cross-section when the enlargement is locked by the key member, thereby preventing rotation of the frame member.

6. The furniture apparatus of claim 3, further comprising a back-support element connected to the frame member.

7. The furniture apparatus of claim 6, wherein at least some of the socket openings are spaced at a center spacing S being a submultiple of the distance D, and the back-support element has a width W being the distance D plus an approximate multiple of the spacing S.

8. The furniture apparatus of claim 1, further comprising a mattress for support by the platform member, the mattress being formed with a plurality of passages therethrough, the passages being alignable with the socket openings for receiving the shank portion of the frame member.

9. The furniture apparatus of claim 1, further comprising a locking device for holding the key member in the locked position.

10. The furniture apparatus of claim 9, in combination with a vehicle having an engine ignition circuit, the combination further comprising an electrical interlock for preventing activation of the ignition circuit when the key member is not in the locked position.

11. The combination of claim 10, further comprising a hanger for supporting an unused fixture.

12. The combination of claim 10, wherein the platform member is one of a pair of platform members, each of the platform members being supported on a respective base of a spaced pair of bases, the combination further comprising a translation mechanism for each of the platform members, the translation mechanisms being operative for locating the platform members in proximate edge abutment for forming a bed, and for moving the platform members in a horizontal first direction into horizontally spaced relation for forming an aisle therebetween.

13. The combination of claim 12, wherein at least one of the translation mechanisms is further operative for moving the corresponding platform member in a horizontal second direction being inclined relative to the first direction.

14. A method for converting a recreational vehicle bed to a couch having a back-support element, comprising the steps of:

(a) providing a platform assembly having a plurality of socket openings in a horizontally disposed supporting surface, a key member movable under the socket openings and having respective key openings in association with the socket openings, and a mattress pad on the supporting surface for forming a bed, the mattress having passages therethrough for alignment with the socket openings, each key opening having an open portion and a lock portion;

(b) providing a fixture having a back-support element and a frame leg extremity, an enlargement being formed on the leg extremity;

(c) inserting the leg extremity into a selected one of the socket openings with the enlargement having passed through the open portion of the corresponding one of the key openings; and (d) moving the key member for locating the lock portion of the key member over the enlargement for locking the fixture to the platform assembly with the back-support element extending above the mattress pad, thereby to provide a couch.

15. The method of claim 14, wherein the step of providing the platform assembly comprises providing a pair of platform assemblies, the method comprising the further steps of anchoring the platform assemblies in edge-abutting relation for forming the bed as a combination of the platform assemblies; and moving at least one of the platform assemblies into horizontally spaced relation with the other of the platform assembly thereby to form an aisle between the platform assemblies.

16. The method of claim 14, wherein the step of providing the fixture includes providing an interchangeable plurality of fixtures, each fixture having a horizontal facing direction; and the step of inserting the leg extremity further comprises selectively locating the fixtures in a plurality of orientations of the respective facing directions, the fixtures being locked in the respective orientations.

17. The method of claim 14, further comprising the further step of locking the key member in the locked position.

18. The method of claim 14, comprising the further steps of providing a switched source of vehicle engine ignition power, and activating the engine ignition power only when the lock member is the locked position.

19. A modular furniture apparatus for supporting occupants of a recreational vehicle, comprising:

(a) a platform member having a horizontally disposed supporting surface, a plurality of socket openings being formed in the supporting surface;

(b) a generally U-shaped frame member having a parallel-spaced pair of shank portions, each shank portion having a free end, an enlargement being formed on each free end, the shank portions being spaced at a distance D, a plurality of pairs of the socket openings being correspondingly spaced at the distance D, each of the shank portions being engageable through selected ones of the socket openings of the platform member for permitting the frame member to be selectively engaged with the platform member and locked in place in a plurality of fixed positions relative thereto;

(c) a back-support element connected to the frame member, at least some of the socket openings being spaced at a center spacing S being a submultiple of the distance D, the back-support element having a width W being the distance D plus an approximate multiple of the spacing S;

(d) a key member movably supported relative to the platform member opposite the socket openings from supporting surface and having a plurality of key openings formed therein, each key opening having an entry portion for passing an enlargement of the frame member and a lock portion for blocking passage of the enlargement while receiving the shank portion, the key member having an open position wherein the entry portion of each key opening is aligned with a corresponding socket opening of the platform member, and a locked position wherein the lock portion of each key opening is aligned with the corresponding socket opening;

(e) a locking device for holding the key member in the locked position; and (f) an electrical interlock for deactivating a vehicle ignition circuit when the key member is not in the locked position, wherein the frame member is rigidly supported in upstanding relation to the platform member when the enlargement is locked by the key member.

* * * * *